US006499144B1

(12) United States Patent
Yan

(10) Patent No.: US 6,499,144 B1
(45) Date of Patent: Dec. 31, 2002

(54) THREE COMPONENT ELASTIC BAND

(76) Inventor: Suen Ching Yan, 17145 Margay Ave., Carson, CA (US) 90746

( * ) Notice: Subject to any disclaimer, the term of this patent is extended or adjusted under 35 U.S.C. 154(b) by 0 days.

(21) Appl. No.: 10/242,379

(22) Filed: Sep. 10, 2002

(51) Int. Cl.[7] ..... A42B 1/00
(52) U.S. Cl. ..... 2/181.2; 450/123
(58) Field of Search ..... 2/181, 181.2, 195.1, 2/195.3; 442/182; 450/123

(56) References Cited

U.S. PATENT DOCUMENTS

| | | | | |
|---|---|---|---|---|
| 1,674,360 | A | 6/1928 | Gstalder | |
| 2,052,123 | A | 8/1936 | Adamson | 2/195 |
| 2,196,808 | A | 4/1940 | Hawley, Jr. | 154/2 |
| 2,338,243 | A | 1/1944 | Hawley, Jr. | 158/48 |
| 3,255,756 | A | 6/1966 | Frei | 128/548 |
| 5,428,843 | A | 7/1995 | Clowers et al. | 2/195.2 |
| 5,447,462 | A | 9/1995 | Smith et al. | 450/122 |
| 5,966,742 | A | 10/1999 | Cunliffe | 2/195.3 |
| 6,199,213 | B1 | 3/2001 | Whang | 2/181 |
| 6,205,590 | B1 * | 3/2001 | Gorman | 2/181 |
| 6,336,224 | B1 * | 1/2002 | Wang | 2/195.3 |
| 6,339,844 | B1 | 1/2002 | Merkley | 2/195.3 |

FOREIGN PATENT DOCUMENTS

| | | |
|---|---|---|
| WO | WO 91/00720 | 7/1990 |
| WO | WO 97/06705 | 7/1996 |

* cited by examiner

*Primary Examiner*—John J. Calvert
*Assistant Examiner*—Katherine Moran
(74) *Attorney, Agent, or Firm*—Cislo & Thomas LLP

(57) ABSTRACT

A three-component band has two outer rows of tighter contraction than a middle row which may be offset from the tops of the outer rows in order to provide a groove or recess. Stitching or the like may be sewn into the groove or recess and the top of such stitching may be flush with the tops of the outer two rows. In some instances no groove, recess or stitching are resorted to. The outer two rows are of generally greater contraction than the middle row such that the middle row may flex to a greater degree than the outer rows thereby forming a band for association with garments including hats, caps and underwear or the like. A moisture absorbing material, such as cotton, may be used in conjunction with the three-component band in order to provide absorption for perspiration or other moisture. A hat of generally non-stretchable and stretchable material may be attached to the three-component band. Bunching or the like of the non-stretchable hat material may occur to accommodate the elastic nature of the three-component band.

16 Claims, 2 Drawing Sheets

THREE COMPONENT ELASTIC BAND

BACKGROUND OF THE INVENTION

1. Field of the Invention

This invention relates to elastic bands for garments and more particularly to a three-component band that may be used with particular advantage for hats, caps and the like and garments.

2. Description of the Related Art

Elastic bands are known in the garment industry for attaching articles of clothing to the wearer such as garters or the like. One example is the use of such elastic in socks, undergarments, athletic clothing, and the like.

Elastic bands, particularly elastic sweatbands, have been used in conjunction with hats, including baseball caps, to provide a sizable fit on a wide variety of head sizes as well as providing protection from sweat rolling into the eyes and onto the face of the cap wearer. Baseball caps often have a front bill which serves to shade the wearer's eyes and are often used in conjunction with sporting and athletic events. Sporting and athletic events obviously include baseball, but can also include running, bicycling, volleyball, hiking, and the like. The baseball cap has certainly become a standard item to such an extent that they are used as promotional tems and favors and are often offered under the moniker of "gimme" caps. Prior sweatbands for hats have included elastic bands that optionally include an bsorbent material such as cotton. Generally, these elastic headbands are uniform in nature and add some type of material which forms the band circumscribing the head of the user. While such elastic headbands have been useful in the past, limitations have arisen with the increasing use of such bands and the additional features that are sometimes desired in such bands.

Once such optional and desired feature for such elastic headbands is the addition of lettering, such as for commercial, athletic, or other logos. When such lettering is added to an elastic band of a uniform nature, the additional threadings stand out from, or are proud, the generally uniform and flat surface of the underlying elastic headband. This can be an obstruction or annoyance to individuals wearing such an elastic headband in conjunction with a hat or cap.

Additionally, the use of uniform elastic material in constructing a headband may provide limited ventilation, as there is continuous contact with the wearer's head over the course of the elastic headband. Also, the elastic properties of the headband may be affected by the uniform nature in that there is generally no degree of independence or freedom between, for example, the top part of the headband and the lower part of the headband.

It has also been found that elastic bands used in garments, particularly undergarments, become frayed after repeated washings and the herein disclosed elastic band overcomes this deficiency, while still providing adequate securement of the garment of the wearer thereof.

Consequently, it can be seen that there are improvements that may be made in the art with respect to elastic bands and the like. The present three-component band addresses many of these to advance the art, and provide a more useful and advantageous elastic band for garments and sweatband or headband for hats, caps or the like.

SUMMARY OF THE INVENTION

In view of the foregoing disadvantages inherent in the known types of elastic bands, sweatbands, and the like now present in the prior art, the present invention provides a new elastic band configuration and construction wherein the same can be utilized for securing garments or a hat or cap to the head while simultaneously providing distinctive and advantageous compression qualities for holding the hat to the head as well as the absorption and obstruction of sweat and the like.

The general purpose of the present invention, which will be described subsequently in greater detail, is to provide a new three component elastic band configuration and construction which has many of the advantages of prior elastic bands, sweatbands and headbands preceding the present invention and/or known heretofore. Many novel features present in the new three component band result in a new elastic band which is not anticipated, rendered obvious, suggested, or even implied by any of the prior art bands and the like, either alone or in any combination thereof.

The three-component band set forth herein has three rows of elastic material with the outer two rows being of tighter construction and contraction than the middle row for ease of comfort. The elastic band is generally comprised of polyester, cotton, and rubber and/or spandex with the outer two rows being approximately 44% polyester, 26% cotton, and 30% rubber spandex. The middle row is approximately 50% polyester, 29% cotton, and 21% rubber spandex. The top and bottom rows are approximately ⅜ inch wide while the middle row is approximately ⅝ inch—or one half inch—wide. Generally, there is a greater percentage of rubber overall in the outer rows so as to provide a tighter fit as compared to the center row which may flex somewhat more independently due to its diminished contraction when compared to the outer rows. The outer two rows are built up slightly and use rubber spandex of a greater diameter so that a groove effect is achieved by the middle row. A small groove is present due to the upstanding nature of the outer two rows as compared to the middle row. This provides, where desired, some space for lettering and the like which may then stand flush with the outer two rows and provide a generally even and uniform surface between the outer two rows and any letter stitched into the middle row. Nylon thread may be used for such lettering.

OBJECTS OF THE INVENTION

It is an object of the present invention to provide a useful band for elastically engaging and circumscribing a garment.

It is another object of the present invention to provide an elastic band that has varying degrees of contraction or elasticity.

It is yet another object of the present invention to provide an elastic band which provides room for stitch lettering or logos.

It is yet another object of the present invention to provide an elastic band which may incorporate a sweatband or the like for the absorption of sweat or other moisture.

These and other objects and advantages of the present invention will be apparent from a review of the following specification and accompanying drawings.

DESCRIPTION OF THE PREFERRED EMBODIMENT(S)

Figure 1:
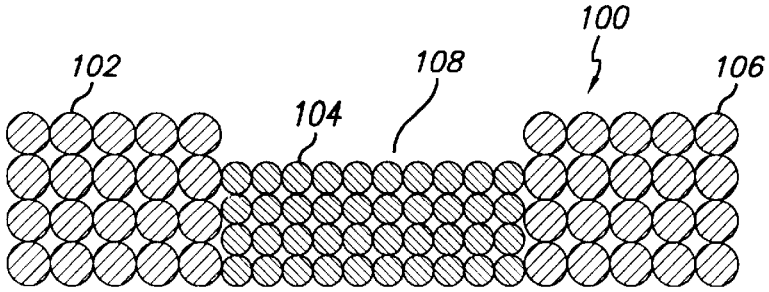
FIG. 1 is a cross-sectional view of the three-component band of the present invention showing the outer two rows on opposite sides of the middle row.

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Referring to the drawings where like numerals of reference indicate like elements throughout, it will be noted that the three component band 100 of the present invention has a first or outer row 102 and here shown as having larger stitching than a middle row 104 followed by a second outer row 106 of the same larger stitching as the first outer row 102. However, where preferred the same size stitching or threads may be used for all three rows 102, 104 and 106.

The two outer rows 102 and 106 may generally be of the same sized stitching material but having a higher rubber spandex component and being of generally tighter contraction or construction than the middle row 104 which has a lower rubber spandex component. Each of the three rows comprises polyester, cotton, and rubber spandex with the outer two rows 102 and 106 having a higher degree of rubber spandex than the middle row 104 and wherein the thickness of the rubber spandex of the rows 102 and 106 is higher than that in the middle row 104, thereby giving greater contraction to outer rows 102 and 106.

Figure 2:
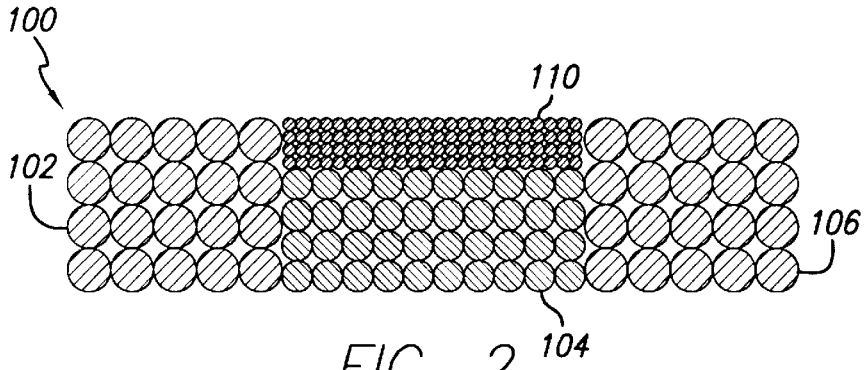
FIG. 2 is a cross-sectional view of the three-component band showing stitching present in the groove or recess between the outer two rows.

The three component band 100 set forth herein may be of various lengths but will be generally about 21½ inches long where a sweatband application is contemplated in order to accommodate most head sizes. Additional sizes may be used as needed for different garments or different sized heads. The three-component band 100 is generally about 1¼ inch in width on the outside of one outer row to the outside of the opposite outer row. The two outer rows 102, 106 are generally ⅜ inch in width while the middle row 104 is generally ⅝ inch in width (½ inch in width). The outer rows 102, 106 may be approximately 2.3 millimeters in height while the middle row 104 is approximately 2.0 millimeters in height. This leaves a groove or recess 108 of approximately 0.3 millimeters in depth, which as shown in FIG. 2, leaves adequate or even ample, room for stitching 110 which may be used to form a design, lettering, or a logo.

In one embodiment, the rubber spandex used in the outer two rows 102, 106 may be spandex of approximately 0.6 millimeters in diameter with a total of 7 strands being used in order to impart elasticity to the outer two rows 102, 106. The inner or middle row 104 may use 14 strands of approximately 0.3 millimeter spandex in order to impart elasticity to the middle row 104. The greater distribution and smaller diameter of the rubber spandex in the middle row 104 has a tendency to give it diminished contraction in comparison to the outer two rows 102, 106. This allows the middle row 104 to flex to a greater degree than the outer rows 102, 106 as the middle row 104 may contract or stretch to a greater degree than the outer rows 102, 106. Generally, the stitching 110 (FIG. 2) is made of nylon and does not flex except to the extent that the fabric used for the stitching 110 (usually nylon) has intrinsic elastic qualities.

The table below indicates by row the percentage component of polyester, cotton and rubber spandex for each of the three rows 102, 104, 106.

| | Polyester | Cotton | Rubber Spandex | Total |
|---|---|---|---|---|
| Outer Row 102 | 43.927% | 25.715% | 30.358% | 100% |
| Middle Row 104 | 49.698% | 29.089% | 21.213% | 100% |
| Outer Row 106 | 43.927% | 25.715% | 30.358% | 100% |

Below in tabular form are the percentage components of one embodiment of the three-component band 100.

| | Polyester | Cotton | Rubber Spandex | Thickness |
|---|---|---|---|---|
| Outer Row 102 | 13.820% | 8.090% | 9.550% | 2.3 mm |
| Middle Row 104 | 18.428% | 10.786% | 7.866% | 2.0 mm |
| Outer Row 106 | 13.820% | 8.090% | 9.550% | 2.3 mm |
| Total | 46.068% | 26.966% | 26.966% | |

Below in tabular form is the percentage of rubber spandex in one embodiment of the three-component band 100.

| | | % Rubber Spandex |
|---|---|---|
| Outer Row 102 | Diameter of Rubber Spandex - 0.6047 mm Total 7 pcs. | 35.415% |
| Middle Row 104 | Diameter of Rubber Spandex - 0.3175 mm Total 14 pcs. | 29.170% |
| Outer Row 106 | Diameter of Rubber Spandex - 0.6047 mm Total 7 pcs. | 35.415% |
| | | 100% |

The outer row 102 and 104 component of elastic band 100 will generally and preferably have an elasticity coefficient of between 50 grams of force/10 millimeters to 75 grams of force/10 millimeters where the width of each of the rows 102 and 104 is ⅜ inch. The elasticity coefficient of the ⅝-inch wide row 104 is between 12–35 grams of force/10 millimeters.

The strength of an individual strand in row 104 using ASTM D2256-1995A standard is 1150 grams with elongation at break being 705.7%, while the individual strand in either row 102 or 106 having a strength of 1570 grams and an elongation of 2333.4%.

In some instances no recess or groove 108 will be preferred where a logo or other embroidery is not desired in which case the middle row 104 will be thicker.

Figure 7:
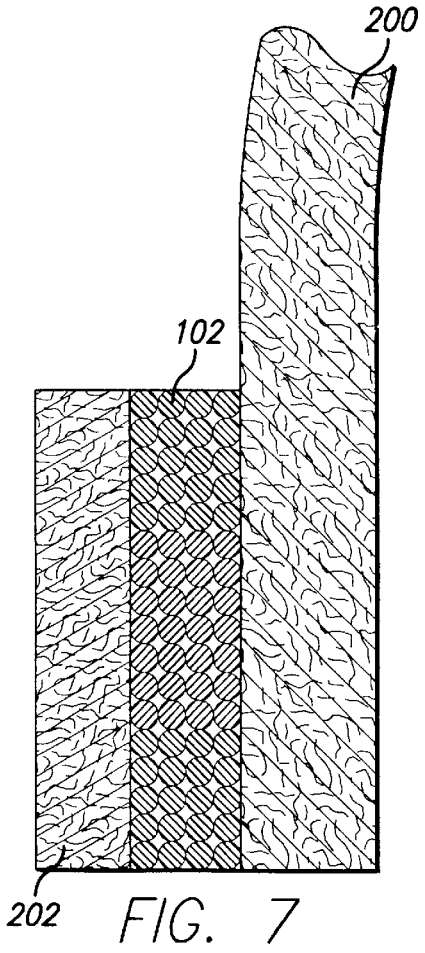
FIG. 7 shows the three-component band utilized exclusively as a sweatband and having a cotton layer overlay.

Also, in some instances it will be desirable to have a separate cotton fabric layer overlaying the elastic band 100 for purposes of comfort and perspiration absorption (FIG. 7).

Figure 3:
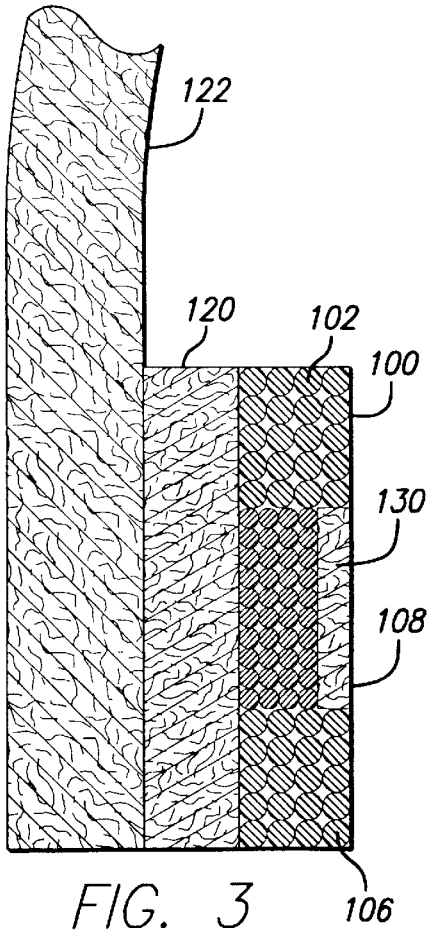
FIG. 3 is a side cross-sectional view of a hat, cap or garment incorporating the three component band of the present invention with the leftnost layer being that of the hat, cap or garment fabric, the middlemost layer being an absorbent layer, and the rightmost layer being the three component band with material such as lettering or other material being present in the groove or recess between the top and bottom rows.
Figure 4:
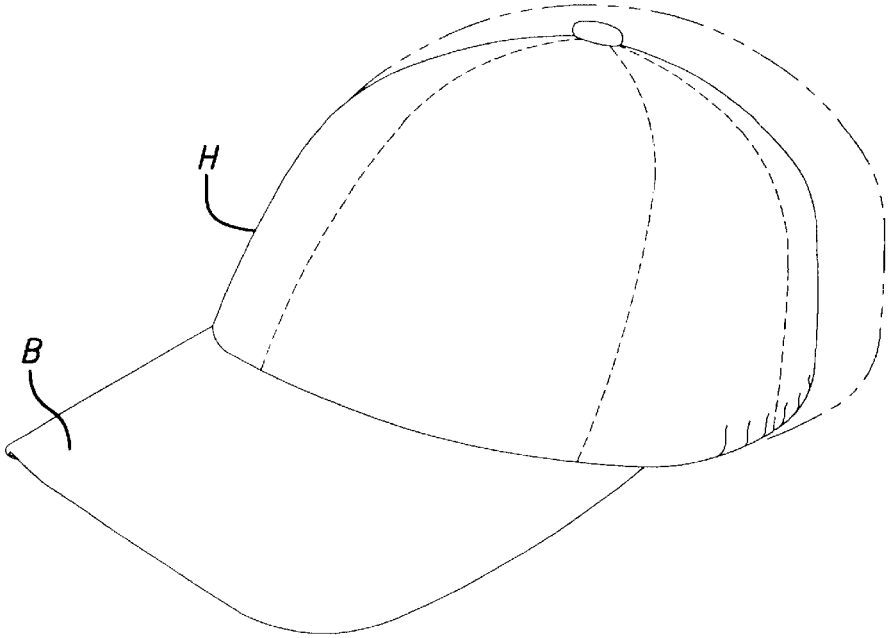
FIG. 4 shows a left front perspective view of a hat incorporating the three-component sweatband.

In an alternative embodiment of the present invention, and as shown in FIG. 3, a cotton sweatband 120 may be additionally used in conjunction with the three component band 100 in order to absorb moisture, particularly sweat. As shown in FIG. 3, the cotton sweatband or moisture-absorbing sweatband 120 is sandwiched between the fabric 122 composing the innermost layer of the garment or hat as seen in FIG. 4. The presence of the moisture-absorbing sweatband 120 enables moisture to migrate from the far side of the three-component sweatband 100 to be absorbed by the moisture-absorbing sweatband 120. Such moisture absorbing material may also be used in the groove or recess 108 and such moisture absorbing material 130 may serve to enhance the moisture absorbing nature of the moisture-absorbing sweatband 120 or may be made of a separate material different than that of the moisture-absorbing sweatband 120.

The moisture absorbing sweatband 120 may travel about the front of the three component sweatband 100 in a strip approximately 8 inches long, the entire length of band 100 or another advantageous length. Alternatively, the moisture-absorbing sweatband 120 may circumscribe the inner surface of the hat fabric much in the same way as the three-component band 100 may. In a cap or a hat, when only a partial strip of the moisture absorbing material is used, it may be disposed towards the front of the cap or hat. With respect to FIG. 4, the front part of the cap may be that immediately adjacent to the bill B of the hat H.

Figure 5:
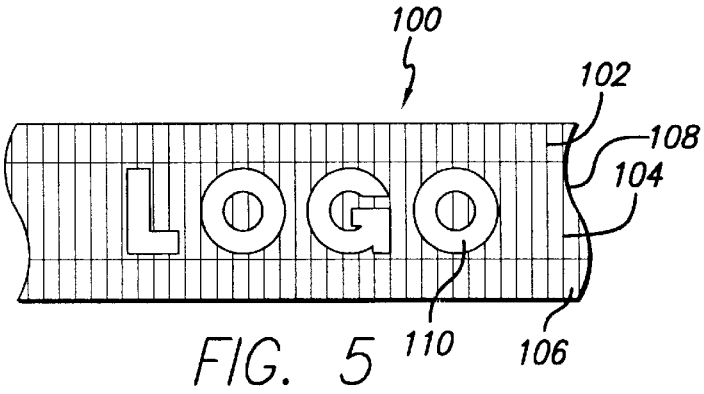
FIG. 5 shows a side partial plan view of the three component band with a stitched logo in the form of the word "LOGO" stitched into the middle row, the three component band being in an unstretched or relaxed state.
Figure 6:
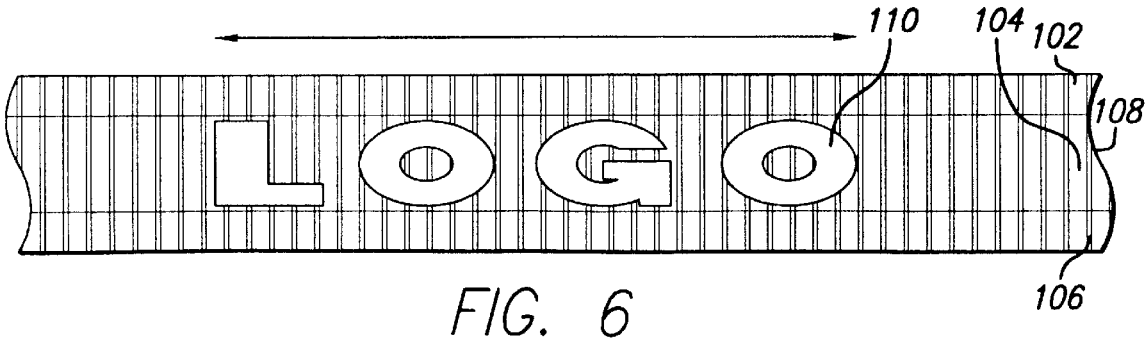
FIG. 6 shows the three-component band of FIG. 5 with the word "LOGO" stitched into the middle row, the band being in a stretched state.

FIGS. 5 and 6 show the three-component band 100 in relaxed and stretched states. The letters composing the word "LOGO" are shown in the groove or recess 108 defined by the outer rows 102, 106 with respect to the inner row 104. FIG. 5 shows the stitched band 100 in a relaxed state while FIG. 6 shows the stitched band in a stretched state.

In the cap embodiment depicted in FIG. 4, the fabric of hat or cap M is non-stretchable and is of slightly larger circumference about its lower periphery so that when the band 100 is stitched onto the inside, small gathers of the fabric are formed at G. Thus, when worn the hat or cap is expanded into a fully extended state which makes for comfortable wearing of the hat or cap. Biaxially and uniaxially material may also be used.

In FIG. 7, the band 102 is shown attached to cap or hat 200 and wherein there is no groove or recess in the middle row of band 102 and illustrating a cotton or the like overlying layer 202.

While the present invention has been described with regards to particular embodiments, it is recognized that additional variations of the present invention may be devised without departing from the inventive concept, all of which are intended to be covered by the appended claims.

What is claimed is:

1. A composite band adapted for association with garments and for circumscribing the wearer, comprising:

a first band portion extending in length for circumscribing said wearer and having a first elasticity;

an intermediate band portion operatively coupled to said first band portion, said intermediate band portion extending in length for circumscribing said wearer and having a second elasticity;

a third band portion operatively coupled to said intermediate band portion opposite said first band portion, said third band portion extending in length for circumscribing said wearer and having a third elasticity;

said first and third elasticities being of tighter contraction than said second elasticity; whereby said composite band provides ease of comfort when donned and worn by said wearer.

2. A composite band for circumscribing the head of a wearer as set forth in claim 1, and further comprising:

said first and third elasticities being generally the same.

3. A composite band for circumscribing the head of a wearer as set forth in claim 2, further comprising:

said first, intermediate, and third band portions comprising polyester, cotton, and elastic.

4. A composite band in accordance with claim 1 wherein said garment is headwear and said band is for circumscribing the head of a wearer and further comprising:

said intermediate band portion being thinner than said first and third band portions to define a recess between said first and third band portions.

5. A composite band for circumscribing the head of a wearer as set forth in claim 4, further comprising:

said recess receiving stitched lettering such that a height of said stitched lettering is generally the same as a height for said first and third band portions.

6. A composite band as set forth in claim 4, further comprising:

said first and third band portions being approximately 2.3 millimeters thick and said intermediate band portion being approximately 2.0 millimeters thick.

7. A composite band as set forth in claim 4, further comprising:

said first and third band portions comprising approximately 44% polyester, 26% cotton, and 30% spandex; and said intermediate band portion comprising approximately 50% polyester, 29% cotton, and 21% spandex.

8. A composite band as set forth in claim 7, further comprising:

said first and third band portions comprising strands of elastic approximately 0.6 millimeters in diameter; and said intermediate band portion comprising strands of elastic approximately 0.3 millimeters in diameter.

9. A composite band as set forth in claim 8, further comprising:

said first and third band portions comprising approximately seven strands of elastic approximately 0.6 millimeters in diameter; and said intermediate band portion comprising approximately 14 strands of elastic approximately 0.3 millimeters in diameter.

10. A composite band as set forth in claim 4, further comprising:

said first and third band portions being approximately ⅜ inches in width; and said intermediate band portion being approximately ⅝ inches in width.

11. A composite band as set forth in claim 4, further comprising:

at least one of said first, intermediate, or third band portions including an absorbent component wherein perspiration may be absorbed by said absorbent band portion and said composite band.

12. A composite band as set forth in claim 11, further comprising:

said absorbent component comprising cotton and having a length selected from the group consisting of a length the same as that of at least one of said first, intermediate, and third band portions and eight inches.

13. A composite band as set forth in claim 4, further comprising:

a hat operatively coupled to said composite band, said composite band generally circumscribing an interior portion of said hat.

14. A composite sweatband adapted for association with headwear and for circumscribing the head of a wearer, comprising:

a first band portion extending in length and being approximately ⅜ inches wide for circumscribing said head and having a first elasticity, said first band portion being approximately 2.3 millimeters thick and comprising approximately 44% polyester, 26% cotton, and 30% spandex, said first band portion comprising approximately seven spandex strands approximately 0.6 millimeters in diameter;

an intermediate band portion operatively coupled to said first band portion, said intermediate band portion extending in length and being approximately ⅝ inches wide for circumscribing said head and having a second elasticity, said intermediate band portion being approximately 2.0 millimeters thick and comprising approximately 50% polyester, 29% cotton, and 21% spandex, said intermediate band portion comprising approximately fourteen spandex strands approximately 0.3 millimeters in diameter;

a third band portion operatively coupled to said intermediate band portion opposite said first band portion, said third band portion extending in length and being approximately ⅜ inches wide for circumscribing said head and having generally said first elasticity, said third band portion being approximately 2.3 millimeters thick and comprising approximately 44% polyester, 26% cotton, and 30% spandex, said third band portion comprising approximately seven spandex strands approximately 0.6 millimeters in diameter;

said intermediate band portion being thinner than said first and third band portions to define a groove between said first and third band portions, said groove capable of receiving stitched lettering such that a height of said stitched lettering is generally the same as a height for said first and third band portions; whereby said first and third elasticities being of tighter contraction than said second elasticity such that said composite sweatband provides ease of comfort when donned and worn by said wearer.

15. A composite sweatband for circumscribing the head of a wearer as set forth in claim 14, further comprising:

at least one of said first, intermediate, or third band portions including an absorbent cotton component having a length selected from the group consisting of a length the same as that of at least one of said first, intermediate, and third band portions and eight inches wherein perspiration from the head may be absorbed by said absorbent band portion and said composite sweatband.

16. A composite sweatband for circumscribing the head of a wearer as set forth in claim 14, further comprising:

a hat operatively coupled to said composite sweatband, said composite headband generally circumscribing an interior portion of said hat.

* * * * *